United States Patent [19]

Satomi

[11] 4,074,934

[45] Feb. 21, 1978

[54] ELECTROSTATOGRAPHIC IMAGING METHOD AND APPARATUS FOR MULTIPLE COPIES

[75] Inventor: Toyokazu Satomi, Tokyo, Japan

[73] Assignee: Ricoh Co., Ltd., Tokyo, Japan

[21] Appl. No.: 661,579

[22] Filed: Feb. 26, 1976

[30] Foreign Application Priority Data

Mar. 17, 1975 Japan ..... 50-32011

[51] Int. Cl.[2] ..... G03G 15/04

[52] U.S. Cl. ..... 355/14

[58] Field of Search ..... 355/14, 69, 71, 3 R, 355/3 BE, 3 DR, 7

[56] References Cited

U.S. PATENT DOCUMENTS

| | | | |
|---|---|---|---|
| 3,732,003 | 5/1973 | Altmann | 355/71 |
| 3,736,055 | 5/1973 | Davidge et al. | 355/14 |
| 3,738,747 | 6/1973 | Hayashi | 355/69 |
| 3,976,375 | 8/1976 | Kurita et al. | 355/14 |
| 4,025,180 | 5/1977 | Kurita et al. | 355/3 R |

*Primary Examiner*—A. D. Pellinen
*Attorney, Agent, or Firm*—Frank J. Jordan

[57] ABSTRACT

A plurality of images of the same original document are formed at equal spacing on the circumference of a photoconductive drum. After all of the images are completely formed, the images are developed a number of times, and the resulting toner images are transferred to copy sheets after each developing step. The method comprises forming an image on one section of the drum and then rotating the drum by a plurality of image spaces before forming an image on another section. The number of image spaces skipped is determined by the number of images to be formed in such a manner that the images will be formed only once during a predetermined number of rotations of the drum.

8 Claims, 7 Drawing Figures

ELECTROSTATOGRAPHIC IMAGING METHOD AND APPARATUS FOR MULTIPLE COPIES

Figure 1:
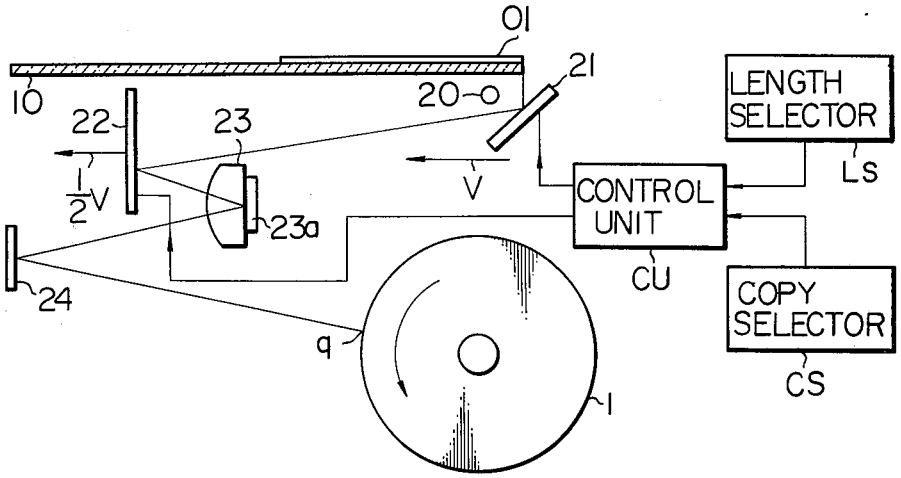

The present invention relates to a method and apparatus for forming a plurality of identical images at equal spacing on the circumference of a photoconductive member such as a drum or endless belt.

In known electrostatographic copying apparatus, a photoconductive drum is imaged, and the image is developed and transferred during one rotation of the drum. Even if the length of an original document for reproduction is less than ½ the circumference of the drum, only one copy will be produced for each rotation of the drum. It is also known in the art to form only once an electrostatic image on a photoconductive drum, and then develop and transfer the image a plurality of times to copy sheets. In the present state of the art, an electrostatic image may typically be developed and transferred up to 10 times in a direct manner and up to 7 times if an intermediate transfer step of the electrostatic image is performed prior to transfer of a developed image. Even if this process is applied to multiple copy applications, only one copy may be produced for each rotation of the drum regardless of the size of the image.

It is also known in the art in applications in which two or more images of a small original document can be spaced on the circumference of a drum to rotate the drum during one scanning operation to form a first image, stop the drum rotation while the scanning system resets, and again rotate the drum for another scanning operation. Whereas this method increases the copying efficiency by producing more than one copy for each rotation of the drum after all of the images have been formed on the drum using the multiple development and transfer method described above, the mechanism for precisely starting and stopping the drum in dependence on the number of images to be produced is necessarily complex and costly.

In another known method of producing a plurality of images on the drum surface, the drum is rotated continuously and the scanning mechanism is reset at high speed between scanning operations, the speed of various members of the scanning mechanism exceeding 1000mm/sec. during such an operation. The power required for driving a scanning mechanism at this speed is excessive, and the high rates of acceleration and deceleration cause scanning lamps and precision optical components to fail rapidly.

It is therefore an object of the present invention to provide a multiple imaging method for electrostatography which overcomes the drawbacks of the prior art.

It is another object of the invention to provide apparatus embodying the above method.

It is another object of the present invention to provide a method of forming a plurality of images of the same original document at equal spacing on the circumference of a photoconductive drum or the like. After all of the images are completely formed, the images are developed a number of times, and the resulting toner images are transferred to copy sheets after each developing step. The method comprises forming an image on one section of the drum and then rotating the drum by a plurality of image spaces before forming an image on another section. The number of image spaces skipped is determined by the number of images to be formed in such a manner that the images will be formed only once during a predetermined number of rotations of the drum. Imaging means for forming the images may comprise a movable scanning member or a flash optical system.

Figure 3:
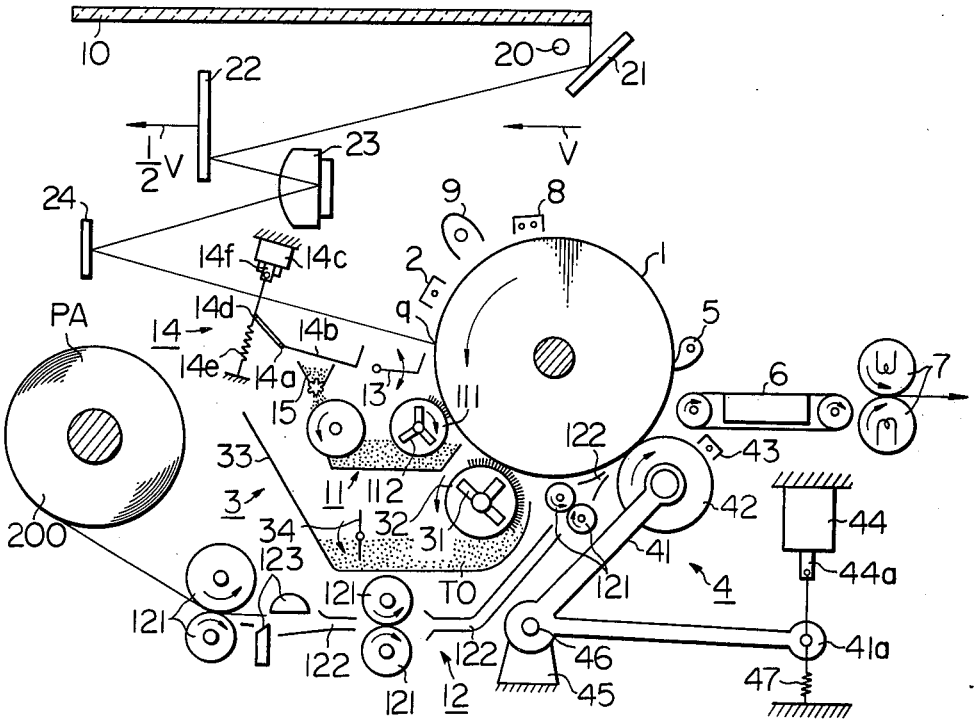
Figures 2A, 2B, 2C, 2D:
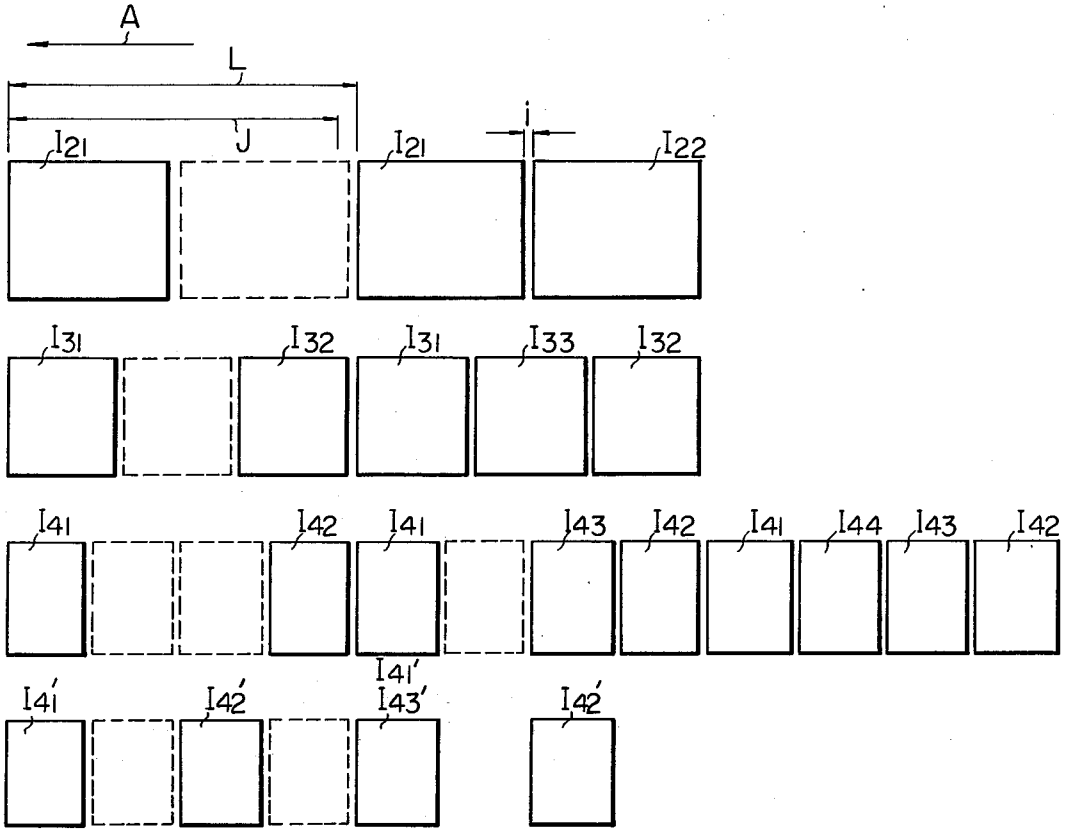
Figure 4:
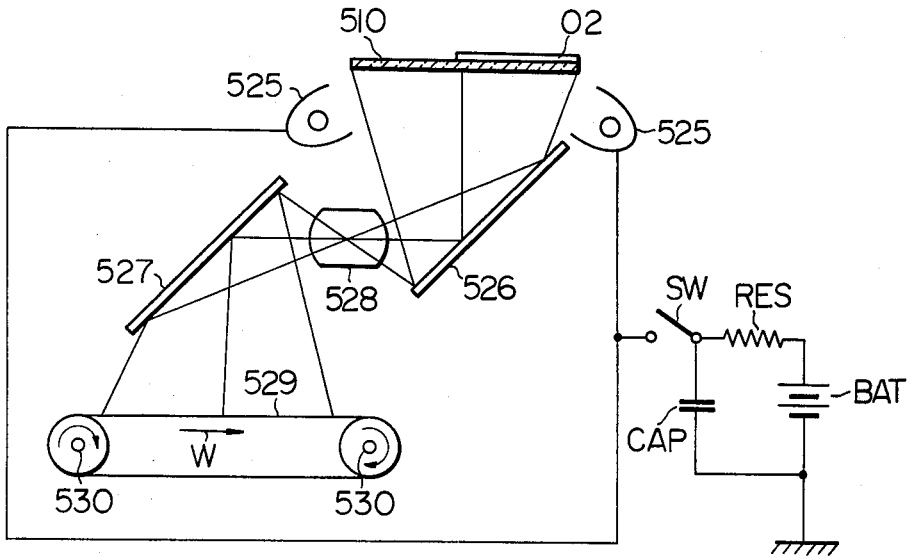

The above and other objects, features and advantages of the present invention will become clear from the following detailed description taken with the accompanying drawings, in which:

FIG. 1 is a schematic view of an image forming apparatus embodying the present invention;

FIG. 2*a* is a diagram illustrating a method of forming two images on the surface of a photoconductive drum in accordance with the present invention;

FIG. 2*b* is similar to FIG. 2*a* but illustrates forming three images;

FIG. 2*c* is similar to FIG. 2*a* but illustrates forming four images;

FIG. 2*d* is a graphic illustration of an inoperative method of forming four images on the surface of a photoconductive drum;

FIG. 3 is a schematic view of the image forming apparatus of FIG. 1 incorporated in an electrostatographic copying machine; and FIG. 4 is a schematic view of another image forming apparatus embodying the present invention.

Referring now to FIG. 1, a transparent document holder or platen 10 is arranged to fixedly retain an original document 01. An imaging system comprises a light source 20 which is arranged to move leftward (as viewed in FIG. 1) in a scan direction integrally with a plane mirror 21 at a velocity V. A return direction is rightward. The mirror 21 reflects an image of the document 01 onto a plane mirror 22 which moves leftward at a velocity ½V. From the mirror 22, the image is reflected and converged by a fixed plano-convex lens or half lens 23 having a rear silvered plane reflecting surface 23*a*. From the lens 23, the image is reflected by a fixed mirror 24 onto the surface of a continuously moving photoconductive drum 1 at a point *q*. The drum 1 has an endless circumference L, and the velocity V is selected to be equal to the surface speed of the drum 1, thereby effecting a scanning operation of the document 01.

The present invention may similarly be practiced by fixing the mirrors 21 and 22 in place and moving the platen 10. It is also possible to move the platen 10 rightward as the mirrors 21 and 22 move leftward.

A length selector LS is provided so that the apparatus operator may input the length of the original document 01 to the apparatus. Although not shown in detail, the length selector LS may comprise a pointer slidable from the right-most edge of the platen 10 to the left edge of the document 01, the pointer being connected to a potentiometer (not shown) by a cable and pulley mechanism. The output of the length selector LS is connected to an input of a control unit CU which controls the movement of the mirrors 21 and 22 and the energization of the light source 20.

The present invention is applicable in cases in which two or more images of the original document 01 may be formed on the circumference of the drum 1. Referring to FIG. 2*a*, the circumferential length of the drum 1 surface is designated as L and the length of a maximum sized original document is designated as J. A margin is therefore provided having a length L–J. It will be understood that the actual length of the largest original document 01 may be larger or smaller than J in applications involving reduced or enlarged scale copying. The length J is that of the image of the maximum sized original document 01 projected on the drum 1 surface by the imaging system. In scanning, the control unit CU controls the mirror 21 to move leftward from its rightmost of initial position by a distance equal to the actual length of the original document 01 and then return to the initial position at the same velocity V. The mirror 22 similarly moves by a distance equal to ½ the length of the original document 01.

The imaging method is graphically illustrated in FIG. 2*a* for forming two images of an original document of length J/2 in two spaces on the drum 1 surface each having a length L/2. The length of margins *i* between the images is equal to ½ the available margin length of L−J or (L−J)/2. It will be assumed that the images are formed on the drum 1 surface in the direction of an arrow A.

The control unit CU energizes the light source 20 and moves the mirrors 21 and 22 as the drum 1 surface moves past the point *q* by a distance L/2 to form a first image of the original document 01 designated as $I_{21}$. The control unit CU then de-energizes the light source 20 and returns the mirrors 21 and 22 to their rightmost positions as the drum 1 surface moves past the point *q* by two distances L/2, thereby skipping two image spaces. The control unit CU then again energizes the light source 20 and mirrors 21 and 22 to produce another image $I_{22}$ as the drum 1 surface moves past the point *q* by a length L/2. It will be seen that during two rotations or movements of the drum 1 surface past the point *q*, two identical images of the original document 01 are formed in an equally spaced manner on the surface of the drum 1. These images are then developed and transferred as will be described below a number of times to produce multiple copies of the document 01.

Before proceeding to the general principles of the present invention, the exemplary cases of forming three and four identical images of original documents having image lengths of J/3 and J/4 respectively will be presented with reference to FIGS. 2*b* to 2*d*.

Referring to FIG. 2*b*, a first image $I_{31}$ is formed on the drum 1. One image space is skipped and another image $I_{32}$ is formed. One more image space is then skipped and a third image $I_{33}$ is formed between the images $I_{31}$ and $I_{32}$. It will be seen that three identical images are formed in two rotations of the drum 1 without overlapping, or forming an image twice on the same portion of the drum 1.

In FIG. 2*c*, a first image $I_{41}$ is formed and two image spaces are skipped. Second, third and fourth images $I_{42}'$ $I_{43}$ and $I_{44}$ are then formed in three rotations of the drum 1 by alternatingly form an image and skipping two image spaces. As in the previous cases, an image is formed on a given portion or section of the drum 1 surface only once.

FIG. 2*d* illustrates an inoperative method of attempting to form four images on the drum 1. In this case, only one space is skipped after forming an image rather than two spaces as in the operative method shown in FIG. 2*c*. Whereas first and second images $I_{41}'$, and $I_{42}'$ are formed satisfactorily, a third image $I_{43}'$ is formed on the same section as the first image $I_{41}'$. This inoperative example illustrates that the number of image spaces to be skipped after forming an image must be properly selected in dependence on the number of images to be formed.

The control unit CU may comprise electronic comparators, cams, or any other known means of determining the number N of images to be formed as a function of the length S of the original document 01. The number N is selected to fulfill the condition $(L/(N+1) < S \leqq (L/N)$ where no margin length L−J is provided and to fulfill the condition $(J/(N+1) > S \leqq (J/N)$ where a margin length L−J is provided. The margin spaces between adjacent images have the length (L/N)−S.

Where K is the number of image spaces to be skipped after forming one image and before forming another image and M is the total number of rotations of the drum 1 for image formation, for all odd values of N, $K=1$ and $M=2$. For even values of N greater than 2, the relation $L=K-2$ generally holds. However, there are usually values of K less than N−2 which provide operative results. The lowest operative value of K is of course the value selected, and for both odd and even lowest operative values of K, $M=K+1$ Table 1 below lists the lowest operative values of K and M for values of N between 2 and 10. The values for N greater than 10 can be determined if required by those skilled in the art.

Table 1

| N | K | M | P |
|---|---|---|---|
| 2 | 2 | 2 | 6 |
| 3 | 1 | 2 | 5 |
| 4 | 2 | 3 | 6 |
| 5 | 1 | 2 | 4 |
| 6 | 4 | 5 | 8 |
| 7 | 1 | 2 | 4 |
| 8 | 2 | 3 | 5 |
| 9 | 1 | 2 | 4 |
| 10 | 2 | 3 | 5 |

Also shown in Table 1 is a parameter P, which represents the number of copies at which it is advantageous to utilize the method of the present invention rather than the conventional method of producing one copy for each rotation of the drum 1. Specifically, for each value of N, the corresponding value of P represents the number of copies which the method of the invention will produce in one less rotation of the drum 1 than the conventional method. As will be described in detail with reference to FIG. 3, the control unit CU preferably comprises means to cause the electrostatographic apparatus incorporating the present imaging system to perform the conventional copying method when the desired number of copies for the given value of N is less than P, and to perform the method of the invention when the desired number of copies is equal to or greater than P. The apparatus comprises a copy selector CS by which the apparatus operator inputs the desired number of copies into the control unit CU. The control unit CU computes the value of N from the length S of the original document 01, and then computes the value of P according to Table 1. The latter function may be performed in a highly advantageous manner by an integrated circuit read-only memory (ROM), which is not shown. The value of P is then compared with the desired number of copies set into the copy selector CS by the control unit CU in order to cause the apparatus to perform the desired imaging operation.

The number of copies which can be produced during R rotations of the drum 1 is (R−M)N, where R is greater than M. Table 2 below shows the number T of copies which can be produced during 10 rotations of the drum 1 for values of N from 2 to 10. As discussed above, an electrostatic image can be developed and transferred up to 10 times in the present state of the art.

Table 2

| N | T |
|---|---|
| 2 | 16 |
| 3 | 24 |
| 4 | 28 |
| 5 | 40 |
| 6 | 30 |
| 7 | 56 |
| 8 | 56 |
| 9 | 72 |
| 10 | 70 |

In each case, the conventional method will produce only 10 copies in 10 rotations of the drum 1 regardless of the size of the original document 01. The method of the present invention will produce as many as 72 copies in 10 rotations of the drum 1. The advantage of the present method will become vividly clear from an examination of Table 2 for applications in which it is desired to make a large number of copies of a small original document 01.

FIG. 3 shows the present imaging system incorporated in an electrostatographic copying apparatus. The drum 1 is rotatable counterclockwise as shown by an arrow relative to a charging unit 2 which applies a uniform electrostatic charge to the surface of the drum 1. Arranged downstream of the charging unit 2 is a developing unit 3 and a transfer unit 4. A separator pawl 5 and discharge conveyor 6 are provided downstream of the transfer unit 4 followed by thermal fixing rollers 7. A discharge unit 8 and discharge lamp 9 are operative to remove any charge from the surface of the drum 1. A cleaning unit 11 for removing any residual developer from the drum 1 surface is located upstream of the developing unit 3. A sheet feed unit 12 is arranged to feed copy paper PA from a roll 200 into contact with the surface of the drum 1 downstream of the developing unit 3. A light valve plate 13 is swingable to adjust the intensity of the image formed on the drum 1. A shutter unit 14 is also provided which will be described in detail below. The apparatus is operative to perform a conventional copying process in which one copy is produced for each rotation of the drum 1 and a copying process embodying the present invention in which a plurality of copies are produced from one rotation of the drum 1.

The conventional method will first be described in conjunction with the detailed construction of the various units of the apparatus.

The document 01 is placed on the platen 10 with one edge aligned with the rightmost edge thereof. The apparatus operator sets the length S of the original document 01 into the control unit CU along with the required number of copies. If the required number of copies is less than P, the control unit CU will cause the apparatus to execute the conventional copying method.

The surface of the drum 1 is charged by the charging unit 2. As the leading edge of the charged portion of the drum 1 reaches the imaging position *q*, the control unit CU energizes the light source 20 and the mirrors 21 and 22 to move leftward in the scan direction. A light sensor (not shown) properly adjusts light valve plate 13 to provide the correct luminous intensity on the surface of the drum 1. The light image causes the drum 1 to locally conduct and dissipate the charge induced thereon to form on electrostatic image.

During this operation, the cleaning unit 11 is rendered inoperative. The developing unit 3 comprises a developing tank 33 which contains powdered developer TO made up of a mixture of toner and carrier particles. A non-magnetic sleeve 32 rotates counterclockwise in the developing tank 33 and has magnets 31 therein which attract the developer TO to the surface of the sleeve 32 to form a magnetic brush. The developer TO particles comprising the magnetic brush are brushed in contact with the drum 1 so that the particles are electrostatically attracted to areas of the drum 1 which retain an electrostatic charge to produce a visual toner image. An agitator 34 is provided in the tank 33 to homogenize the developer TO.

Feed rollers 121 feed the copy paper from the roll 200 through a cutter 123 and guide 122. The cutter 123 is controlled by the control unit CU to cut the copy paper PA to the length S. Other feed rollers which are also designated as 121 feed the cut copy paper PA into contact with the drum 1 in alignment with the leading edge of the electrostatic image.

The transfer unit 4 comprises a bellcrank lever 41 which is pivotal about a pin 46 provided to a fixed member 45. An upper end of the lever 41 rotatably carries a transfer roller 42 having a surface coated with an insulating plastic material. A charger 43 is arranged adjacent to the surface of the roller 42 to apply a charge thereto which has a polarity opposite to that of the charging unit 2. A lower end 41*a* of the lever 41 is urged downward by a tension spring 47 so that the lever 41 is urged clockwise and the roller 42 is urged away from the surface of the drum 1. A solenoid 44 has a plunger 44*a* which is alos connected to the end 41*a* of the lever 41. When the solenoid 44 is de-energized, the roller 42 is maintained out of engagement with the drum 1 by the spring 47. As the copy paper PA engages with the drum 1, the solenoid 44 is energized by the control unit CU so that the lever 41 is rotated counterclockwise and the roller 42 is urged to press the copy paper PA against the surface of the drum 1. The pressure and charge of the roller 42 cause the toner image to be transferred to the copy paper PA. The copy paper PA is separated from the drum 1 by the separator pawl 5, and conveyed by the discharge conveyor 6 through the thermal fixing rollers 7 which fix the toner image onto the copy paper PA and out of the apparatus.

The cleaning unit 11 comprises a rotary sleeve 111 containing magnets 112. After the surface of the drum 1 is discharged by the discharging unit 8 ad discharging lamp 9, the sleeve 111 acts as a magnetic brush to remove residual developer TO from the drum 1. A toner replenishment unit 15 is also shown. The light source 20 is de-energized and the mirrors 21 and 22 are returned to their rightmost positions in preparation for another copying operation. The solenoid 44 is de-energized to de-actuate the transfer unit 4.

When the required number of copies is equal to or greater than P, the control unit CU executes the method of the present invention. The charging unit 2 is energized for one rotation of the drum 1, and the cleaning unit 3, feed unit 12, transfer unit 4, discharge unit 8 and discharge lamp 9 are de-energized during the imaging operation. As the leading edge of the charged portion of the drum 1 reaches the point *q*, the light source 20 and mirrors 21 and 22 are energized to perform a first scan operation, with the mirror 21 moving leftward by the distance S. The light source 20 is de-energized and the mirrors 21 and 22 are returned to their rightmost positions. During this time, the drum 1 is allowed to rotate by a distance corresponding to L/N to skip one image space. It will be understood that since S is equal to or less than L/N even if a margin length L−J is not provided, the mirrors 21 and 22 have sufficient time to return to their initial positions at the scan velocities V and V/2 respectively. If $K=1$, the lamp 20 and mirrors 21 and 22 will be energized after the drum 1 has rotated so as to skip one image space. If $K \geqq 2$, the light source 20 and mirrors 21 and 22 will remain de-energized until K image spaces have been skipped. The process of imaging and skipping one or more image spaces is repeated until the drum 1 has completed M rotations and the N images have been formed.

The developing unit 3, sheet feed unit 12 and transfer unit 4 are then energized. The cutter 123 cuts the copy paper PA into lengths S, and the developing and transfer process described above is performed continuously until the desired number of copies have been produced. The cleaning unit 11, discharge unit 8 and discharge lamp 9 are then energized to prepare the drum 1 for another copying operation, the developing unit 3, transfer unit 4 and sheet feed unit 12 being de-energized.

The drum 1 rotates a number of times after the imaging process is completed to produce the desired copies. The electrostatic images on the drum 1 are developed the same number of times with the resulting toner images being transferred to the copy paper PA. It is advantageous not to energize the cleaning unit 3 during this process since about 10–20% of the developer TO remains on the drum 1 after each transfer operation to constitute a residual image. The developing efficiency is increased if this residual developer TO is allowed to remain on the drum 1 until the copying operation is finished.

As shown in FIG. 3, the shutter unit 14 is preferably included in the imaging system. The shutter unit 14 comprises a shutter blade **14*b* which is pivotal about a pin 14*a* so as to be movable into or out of the image path from the mirror 24. A tension spring 14*e* connected to an end 14*d* of the plate 14*b* urges the blade 14*b* counterclockwise to block the light path. A solenoid 14*c* has a plunger 14*f* which is also connected to the end 14*d* of the blade 14*b***.

When the control unit CU energizes the light source 20, it also energizes the solenoid **14*c* so that the plunger 14*f* rotates the blade 14*b* clockwise to unblock the light path. The shutter unit 14 allows more precise timing of the imaging than simply energizing and de-energizing the light source 20, and eliminates partial imaging during the lighting and extinction times of the light source 20. This is especially important where the margins between adjacent images are small. The shutter unit 14** further allows the use of inexpensive light source lamps which have relatively high lighting and extinction times.

Another embodiment of the present invention is shown in FIG. 4, and comprises a platen 510 for fixedly holding an original document 02. Electrical discharge flash lamps 525 are arranged to illuminate the document 02 through the platen 510. A fixed plane mirror 526 is arranged to reflect an image of the document 02 through a converging lens 528 onto a plane fixed mirror 527 which reflects the image onto the surface of an endless photoconductive belt 529. The belt 529 is trained around rollers 530 and driven thereby at a constant speed W as shown by arrows. The perimeter of the belt 529 is substantially equal to 3 times the length of a maximum sized original document 02.

A power source is symbolically represented by a battery BAT. An electrical storage means in the form of a capacitor CAP is connected in series with a resistor RES across the battery BAT. The capacitor CAP normally charges from the battery BAT through the resistor RES, and discharges through the flash lamps 525 when a switch SW is closed to illuminate the document 02.

The belt 529 is driven continuously, and the flash lamps 525 are fired to image the belt 529. In order to prevent blurring of the image on the belt 529, the duration of the flash must be very small. Also, the intensity of the flash lamps 525 must be high in order to form the entire image instantaneously. An excessive amount of electrical power would be required to charge the capacitor CAP during the time the belt 529 moves by only image space in the present state of the art.

The present invention allows the belt 529 to move by two image spaces between flashes to form three images of a maximum size original document 02 on the belt 529 in the same manner illustrated in FIG. 2b. Specifically, the flash lamps 525 are fired to produce one image, the belt 529 is moved by two image spaces and then the flash lamps 525 are fired again to form a second image with a blank space between the first and second images. During a second complete movement of the belt 529 relative to the platen 510, in which another image space is skipped, the lamps 525 are fired a third time to form a third image between the first two images. By increasing the length of time between firing operations of the flash lmaps 525, the capacitor CAP is given a longer time to charge and the power requirements of the battery BAT are decreased to a practical level.

The present invention can of course be applied to an original document 02 of any length less then one-third the circumference of the belt 529 in such a manner that three, four or any number of images of the original document 02 can be formed on the belt 529. The method is also applicable to apparatus in which the circumference of a photoconductive belt is substantially equal to the length of a maximum sized document or any other multiple thereof. As mentioned above, whereas the lowest operative value of K is selected in the embodiment of FIG. 1 in order to minimize the number of rotations of the drum 1 required to produce the required number of copies, in the embodiment of FIG. 4 it may be desirable to increase the number of rotations in order to give the capacitor CAP even more time to charge between flashes. Where $N=3$, operative values of K include 1, 3, 4 and 6. It will be noted that the relation $M=K+1$ does not necessarily hold for values of K which are not the lowest operative values.

The flash lamps 525 may be made movable, or light valve means (not shown) may be provided to control the exposure in the embodiment of FIG. 4. The present imaging method is also applicable to an electrostatographic system in which a primary electrostatic image is utilized to produce an electrostatic image on another member which is subsequently developed, although not shown or described. Other applications and modifications within the scope of the present invention will be possible for those skilled in the art after receiving the teachings of the present disclosure.

What is claimed is:

1. A method of forming N identical images on N identical respective sections of an endless continuously moving surface of a photoconductive member of circumference L utilizing imaging means, each of the N sections being having a length L/N, all of the N identical images being completely formed prior to development and transfer thereof, the method comprising the steps of alternatingly:

(a) energizing the imaging means as one of the N sections passes thereby; and (b) de-energizing the imaging means as K of the N sections passes thereby, K being selected in dependence on N in such a manner that the N images will be formed on the N sections respectively only once during M movements of the surface of the photoconductive member past the imaging means, N, K and M being integers, a value of N being greater than one, whereby after steps (a) and (b) the N identical images are simultaneously developed and transferred a plurality of times.

2. The method of claim 1, in which values of K and M for values of N between 2 and 10 comprise the following:

| N | K | M |
|---|---|---|
| 2 | 2 | 2 |
| 3 | 1 | 2 |
| 4 | 2 | 3 |
| 5 | 1 | 2 |
| 6 | 4 | 5 |
| 7 | 1 | 2 |
| 8 | 2 | 3 |
| 9 | 1 | 2 |
| 10 | 2 | 3 |

3. The method of claim 1, in which values of K and M for odd values of N are equal to one and two respectively.

4. The method of claim 1, in which the imaging means comprises a scan member movable in a scan direction and a return direction, step (a) comprising moving the scan member in the scan direction and step (b) comprising moving the scan member in the return direction.

5. The method of claim 1, in which the imaging means comprises an electrical discharge light source and electrical storage means, step (a) comprising discharging the storage means through the light source to produce light and step (b) comprising charging the storage means.

6. The method of claim 1, in which the imaging means comprises a shutter means, step (a) comprising opening the shutter means and step (b) comprising closing the shutter means.

7. The method of claim 1, in which each of the N sections comprises an image portion and a margin portion, a length of each image portion being equal to J/N and a length of each margin portion being equal to (L−J)/N where J has a predetermined value.

8. The method of claim 1, in which M is equal to two when N is equal to two, and $M=K+1$ for N greater than two.

* * * * *